US007236722B2

(12) United States Patent
Portig

(10) Patent No.: US 7,236,722 B2
(45) Date of Patent: Jun. 26, 2007

(54) HELICALLY SPLINED DRIVE MEMBER FOR AN IMAGE FORMING DEVICE

(75) Inventor: Harald Portig, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/211,883

(22) Filed: Aug. 25, 2005

(65) Prior Publication Data

US 2007/0048015 A1 Mar. 1, 2007

(51) Int. Cl.
*G03G 15/02* (2006.01)
*G03G 15/08* (2006.01)
*G03G 15/16* (2006.01)

(52) U.S. Cl. ..... 399/167; 399/121; 399/122

(58) Field of Classification Search ..... 399/167, 399/121, 122
See application file for complete search history.

(56) References Cited

U.S. PATENT DOCUMENTS 4,839,690 A 6/1989 Onoda et al.
4,914,478 A 4/1990 Yashiki
5,432,590 A 7/1995 Nomura et al.
5,926,673 A 7/1999 Foster et al.
6,173,146 B1 1/2001 Wang et al.
6,438,341 B1 8/2002 Matsuoka
6,459,869 B2 10/2002 Nittani et al.
6,463,234 B2 10/2002 Arimitsu et al.
6,473,580 B1 10/2002 Inomata
6,501,926 B1 12/2002 Watanabe et al.
6,501,927 B1 12/2002 Watanabe et al.
6,684,041 B2 1/2004 Yokomori et al.
6,725,004 B2 * 4/2004 Ahn et al. ..... 399/167
6,768,890 B2 7/2004 Cho et al.
2003/0059233 A1 * 3/2003 Jang et al. ..... 399/167

* cited by examiner

*Primary Examiner*—David M. Gray
*Assistant Examiner*—Ruth LaBombard
(74) *Attorney, Agent, or Firm*—Coats and Bennett, PLLC

(57) ABSTRACT

Embodiments for driving a removable element within an image forming device. An output member positioned within the image forming device mates with an input member of the removable element. The members include ribs that mate together such that rotational force from the output member is transferred to the input member. The ribs of the members include non-complementary contact surfaces that provide for limited contact along the contact surfaces that accurately transfers the driving force.

20 Claims, 6 Drawing Sheets

HELICALLY SPLINED DRIVE MEMBER FOR AN IMAGE FORMING DEVICE

BACKGROUND

Rotary power should be smoothly and regularly transmitted to components within an image forming device. This includes transmitting rotary power from a drive mechanism in an image forming device to elements that may be removable from the image forming device, such as developer cartridges. The rotary power and operation of the removable element is controlled through the image forming device itself.

It is important that the connection between the removable element and the image forming device allow for accurate control. Previous image forming devices have used various coupling designs in an attempt for accurate control. However, these designs often resulted in disengagement between the removable element and the image forming device. Disengagement interrupts the smooth and regular transmission of the rotary power, and adversely affects the quality of image formation. Further, once the removable element and image forming device start to periodically disengage, the frequency of disengagement slowly increases as the interface progressively wears. Thus the progressive wear causes more frequent print defects.

Thus, there exists a need to transmit rotary motion reliably and accurately from the drive mechanism of the image forming device to the removable element.

SUMMARY

The present invention is directed to embodiments for driving a removable element within an image forming device. An output member positioned within the image forming device mates with an input member of the removable element. Each of the members includes ribs that contact such that rotational force from the output member is transferred to the input member. The ribs of the members include non-complementary contact surfaces having limited contact along the contact surfaces that accurately transfers the driving force.

DETAILED DESCRIPTION

Figure 1:
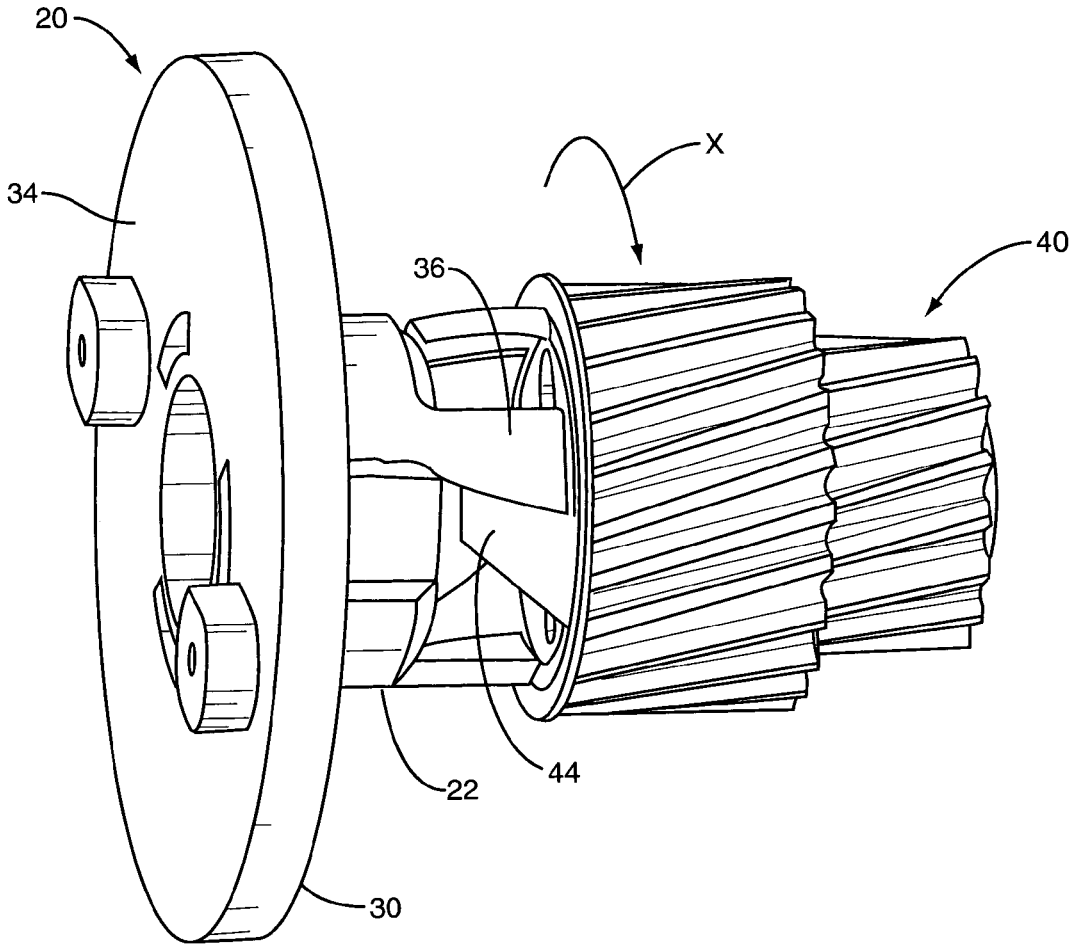
FIG. 1 is a perspective view illustrating one embodiment of an output member coupled with an input member in accordance with the present invention.
Figure 2:
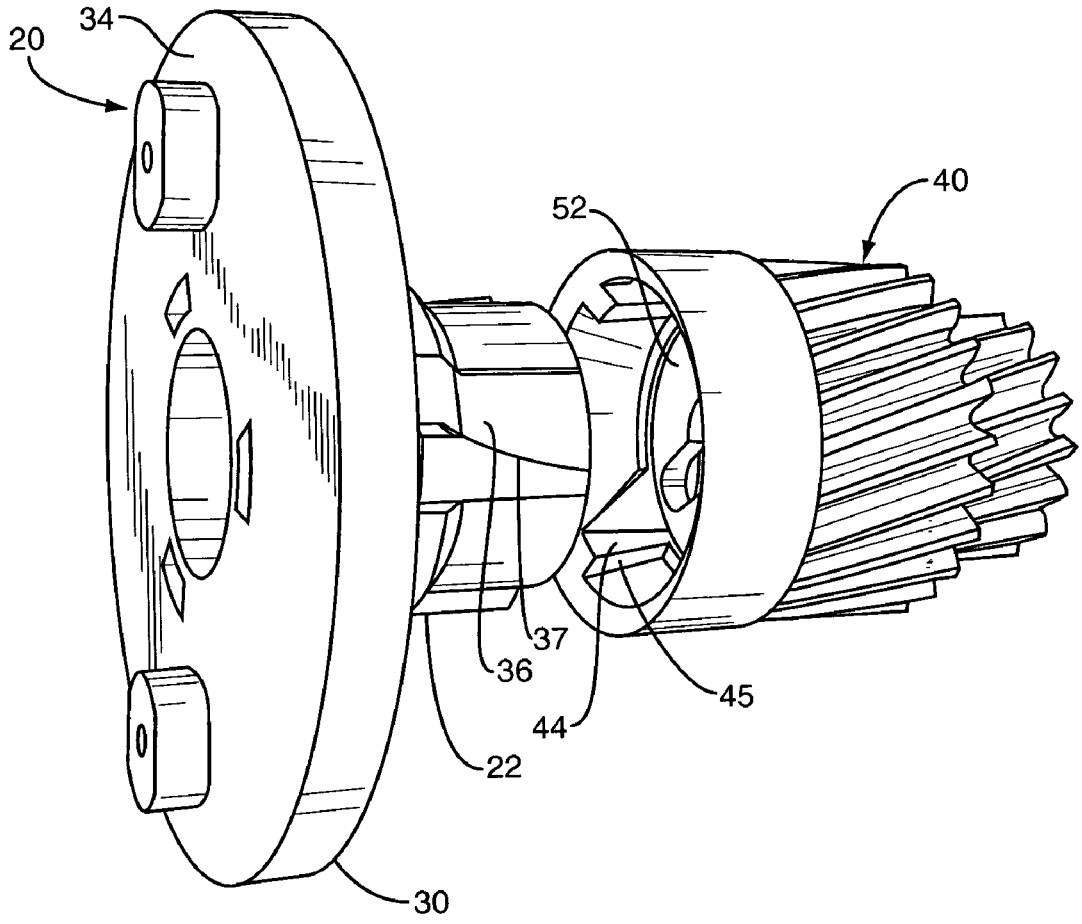
FIG. 2 is a perspective view illustrating one embodiment of an output member and an input member in an uncoupled state in accordance with the present invention.

The present application is directed to embodiments for driving a removable element with an image forming device. With reference to FIGS. 1 and 2, an output member 20 positioned within the image forming device mates with an input member 40 of the removable element. The members 20, 40 include ribs 36, 44 that contact such that rotational force from the output member 20 is transferred to the input member 40 during rotation in direction of arrow X. The ribs of the members 20, 40 include non-complementary contact surfaces 37, 45 having limited contact that accurately transfers the driving force from the image forming device to the removable element.

Figure 3:
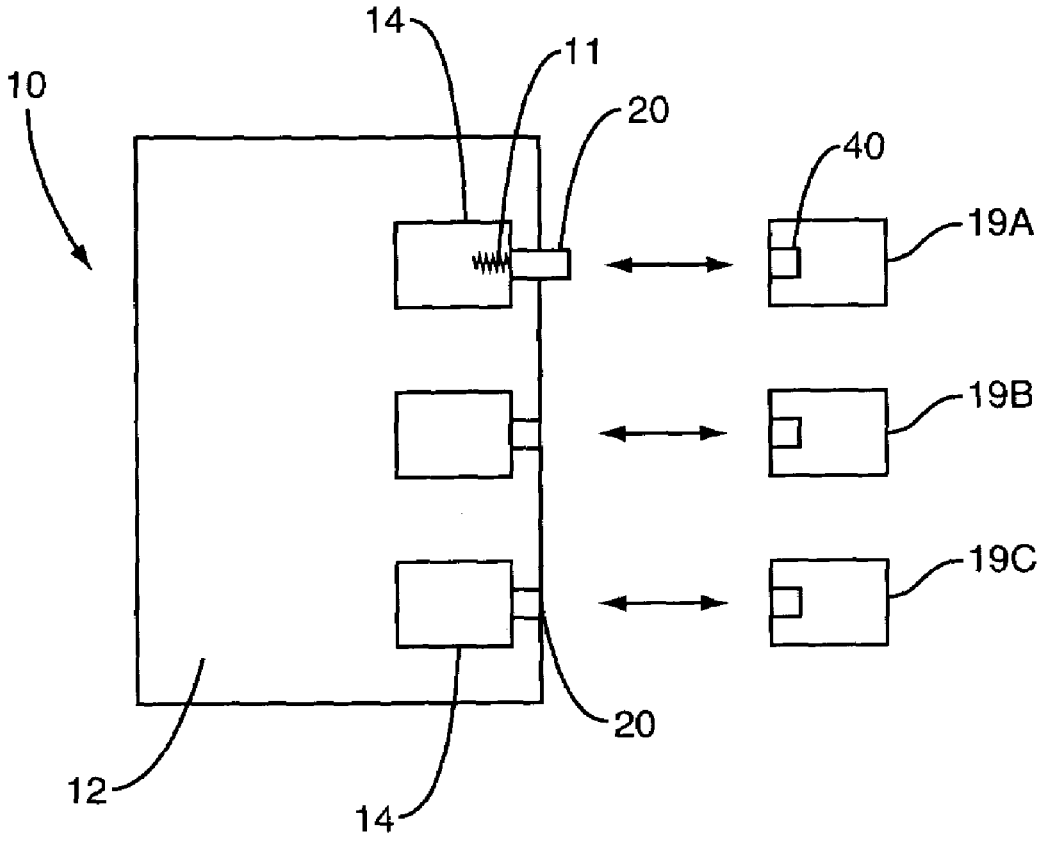
FIG. 3 is a schematic diagram illustrating generally an image forming device and removable elements in accordance with one embodiment of the present invention.

One application of the present invention is generally illustrated in FIG. 3. The image forming device, generally illustrated as 10, includes a main body 12 and one or more drive mechanisms 14 each having an output member 20. Output members 20 may be positioned within the main body 12, or may extend outward from the main body 12. The drive mechanisms 14 are attached to and provide rotation to the output members 20.

Various different types of units 19 may be mounted to the main body 12. In the example of FIG. 3, units 19 may include a toner cartridge 19A, transfer belt module 19B, and fuser assembly 19C. Each of the units 19 includes an input member 40 that mates with the output member 20 to receive rotational power from the drive mechanism 14. These units 19 are not independently powered but rather obtain power from the main body 12. Various different types of units 19 may be attached to the main body 12. These units 19 may be referred to as customer replaceable units as the customer can remove and replace the units as necessary, such as when the unit has expired and is in need of replacement.

Figure 4:
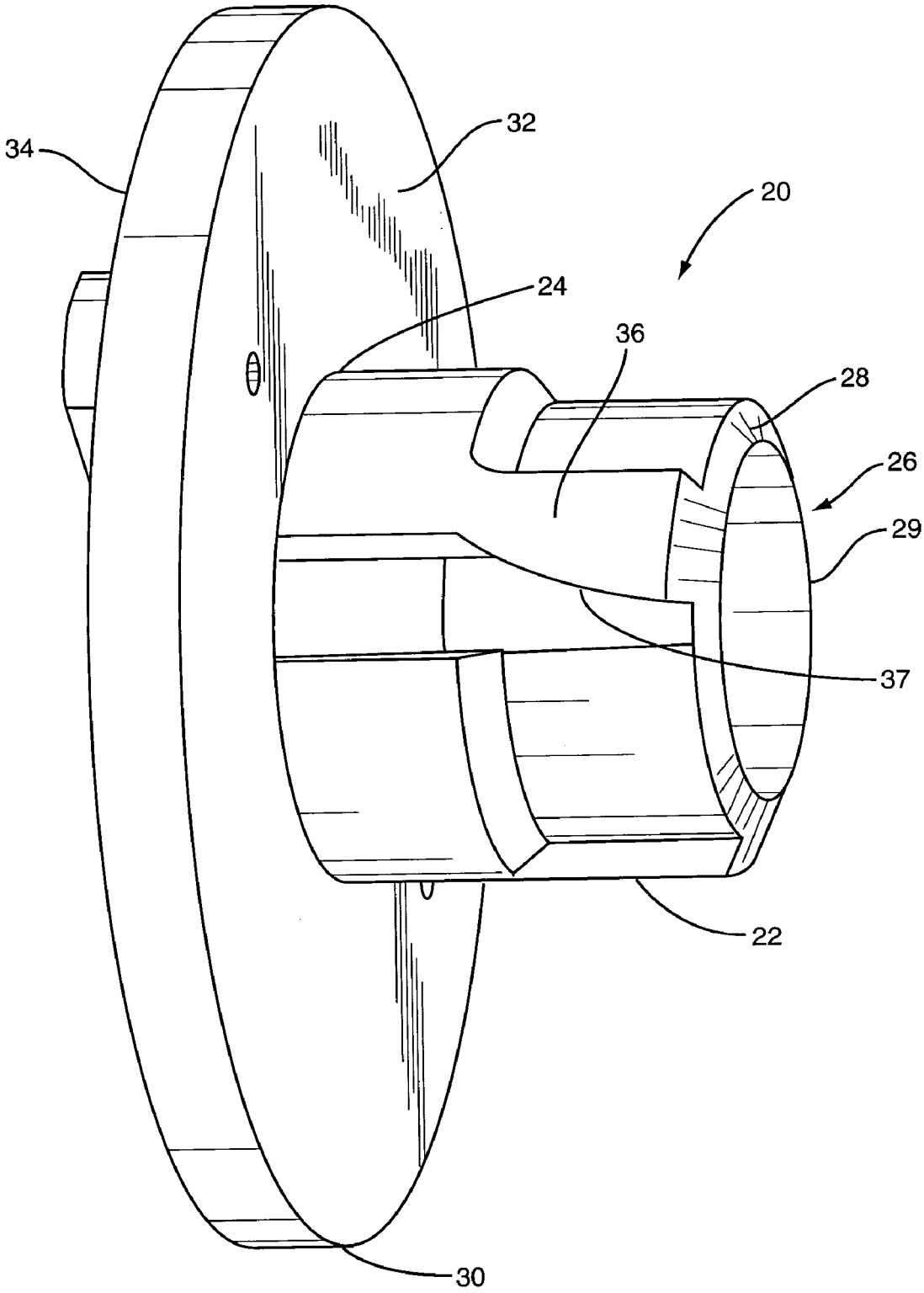
FIG. 4 is a perspective view illustrating an output member in accordance with one embodiment of the present invention.

Member 20 is referred to as the output member because it transfers the power from the drive mechanism 14 out to the attached unit 19. FIG. 4 illustrates one embodiment of the output member 20. In this embodiment the output member 20 has a shaft 22 with first and second ends 24, 26. The shaft 22 has a generally circular cross section defining a first width, and a hollow center. The hollow design has maximum torsional stiffness for a given amount of material, requires less material to make the shaft 22 resulting in less weight and material cost, and helps with molding during manufacturing of the member 20.

A first end 24 of the shaft 22 may be connected to a base 30 or may be formed integrally therewith. The base 30 couples the shaft 22 to the drive mechanism 14 in the image forming device 10. In one embodiment the base 30 has a generally circular shape with a first side 32 and a second side 34. The second side 34 of the base 30 may include elements for engaging the drive mechanism 14 in the image forming device 10. The second side 34 may also provide a surface for applying a biasing force to push the output member 20 outward from the main body 12. In one embodiment illustrated in FIG. 3, a biasing member 11 is positioned between the output member 20 and main body 12 to apply the biasing force.

A second end 26 of the shaft 22 extends distally away from the base 30. An edge 29 formed at the distal end forms a planar, generally circular surface. An outwardly tapered section 28 extends between the edge 29 and an outer surface of the shaft 22. The tapered section 28 assists in controlling the alignment and centering of the output member 20 relative to the input member 40 as will be explained in detail below.

Ribs 36 extend substantially radially outward from the shaft 22. The ribs 36 may extend a limited distance along the shaft 22, or may extend along the entire length of the shaft 22. The width of the ribs 36 may be substantially constant along their length, or may vary, such as increasing in width the further away from the distal end 26. The ribs 36 further include arcuate contact surfaces 37 for engaging the input member 40. The arcuate contact surfaces 37 may extend along the entire length of the ribs 36 or may run a limited distance along the ribs 36.

Figure 5:
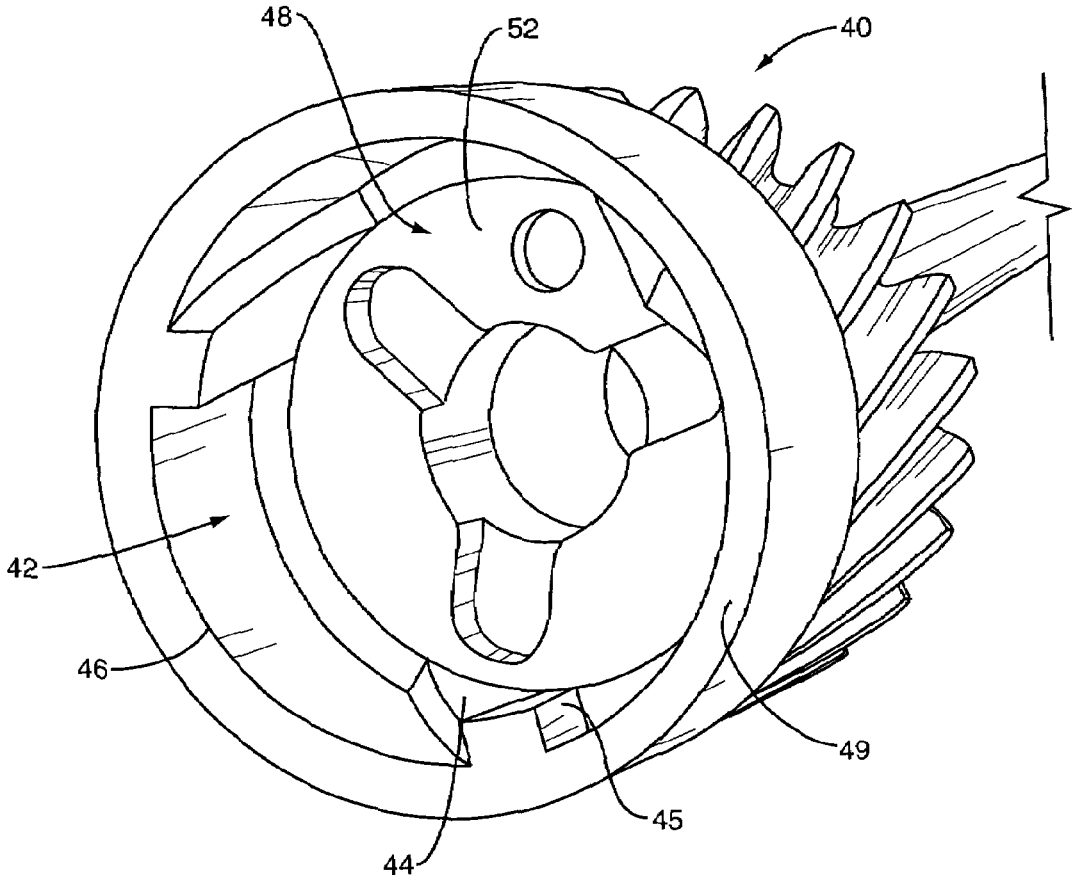
FIG. 5 is a perspective view illustrating an input member in accordance with one embodiment of the present invention.

Member 40 is referred to as the input member because it receives rotational power from the output member 20. FIG. 5 illustrates one embodiment of the input member 40. In this embodiment, the input member 40 has a central cavity 42 with a generally circular cross-section sized to receive the shaft 22. The cavity 42 includes ribs 44 axially extending along the cavity 42 that are contacted by the output member ribs 36. The cavity 42 is centered about the axis of the input member 40 and extends between a first end 46 and a second end 48. The first end 46 is open to receive the shaft 22 and includes an inwardly-tapering surface 49 that assists with mating and alignment with the output member 20. The second end 48 is formed by a planar surface 52 that corresponds to the edge 29 on the distal end 26 of the shaft 22.

In the embodiment of FIG. 5, ribs 44 are disposed along the cavity 42 and extend substantially radially inward to mate with the output member 20. The ribs 44 may be disposed along a limited length of the cavity 42, or may extend along the entire length of the cavity 42. In the embodiment of FIG. 5, the ribs 44 extend along the length of the cavity 42. The ribs 44 may also have a decreasing width in a direction of the first end 46 of the cavity 42. The ribs 44 further include generally linear contact surfaces 45 for engaging the output member 20. The contact surfaces 45 may extend along the entire length of the ribs 44 or may run only a limited distance along the ribs 44.

In one embodiment, the contact surfaces 45 are oriented about the cavity 42 in a helical orientation. When a driving force is transmitted from the output member 20 to the input member 40, a thrust force is generated to pull the output member 20 toward the input member 40 and engage the ribs 36, 44.

The arcuate contact surfaces 37 of the output member 20 and the generally linear contact surfaces 45 of the input member 40 are non-complementary. When mated, the contact surfaces 37, 45 of the output member 20 and the input member 40 incompletely contact one another and have limited line contact 54. Outside this limited contact 54, however, the contact surfaces 37, 45 are not engaged with one another. Because the surfaces are purposefully non-complementary, minor variations in the construction of the members 20, 40, and/or variations in the mounting of the members 20, 40 do not cause differences in the location and amount of contact between the two members 20, 40. Conversely, if the surfaces were intended to be complementary, minor variations in the construction and/or mounting would cause the location and amount of contact to be greatly affected.

Figure 6:
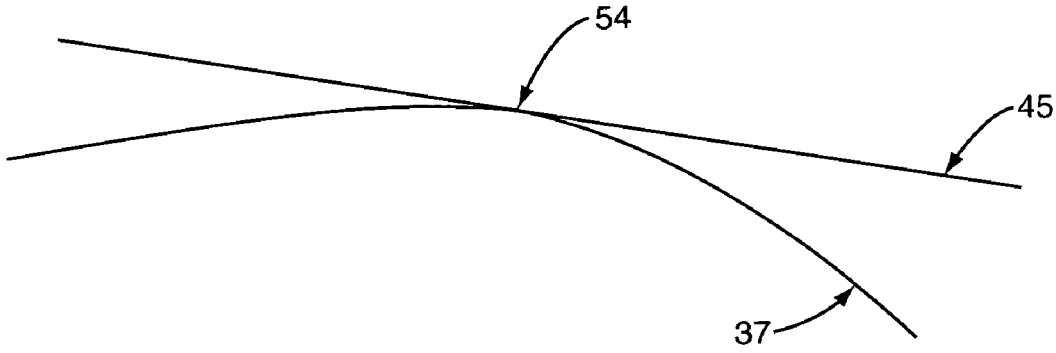
FIG. 6 is a schematic view illustrating the limited contact between the output member and the input member in accordance with one embodiment of the present invention.

The contact 54 is positioned along the contact surfaces 37, 45. The rotary power of the drive mechanism 14 is transmitted from the output member 20 to the input member 40 through the contact 54. FIG. 6 illustrates one embodiment of the limited line contact 54. In this embodiment, the contact 54 is a single contact locus between the contact surfaces 37, 45. Prior art devices use area contact along an extended axial length of the ribs.

With reference to FIGS. 1–2, biasing mechanism 11 applies an outward force that pushes the output member 20 towards input member 40. Tapered surface 28 on the output member 20 contacts the tapered surface 49 of the input member 40 to initially align the two members. During initial rotation of the driving mechanism 14 the output member 20 rotates relative to the input member 40. This may be caused by the ribs 36, 44 being misaligned (i.e., spaced apart) when the attached unit 19 is initially mounted within the image forming device 10. As the shaft 22 is rotated, the arcuate contact surfaces 37 of the output member 20 and the generally linear contact surfaces 45 of the input member 40 contact each other. The contact surface 37 of the output member 20 slides along the contact surface 44 of the input member 40 as the shaft 22 is rotated and the members 20, 40 are pulled together. The members 20, 40 pull together until the planar edge 29 on the distal end 26 of the shaft 22 contacts against the planar surface 52 of the cavity 42. The contact between these two planar features seats the shaft 22 within the cavity 42 and keeps the axes of the two members 20, 40 parallel to each other.

The contact surfaces 37, 45 are in contact with each other to deliver the rotational force of the output member 20 to the input member 40. Due to manufacturing tolerances, the ribs 36 may have slightly different physical characteristics, and the ribs 44 may also have different physical characteristics. This results in the limited contact occurring at a different radial location along each of the ribs 36, 44. The non-complementary contact surfaces 37, 45 are designed to correct this misalignment during initial rotation by sliding past each other until the edge 29 at the distal end 26 bottoms out against the surface 52 and the contact surfaces 37, 45 contact in the area of limited contact 54. The contact occurs along the contact surface 37, 45 at axial positions that are unique to each contact surface 37, 45.

One embodiment of the output member 20 and input member 40 has been shown and described with three ribs 36, 44 having non-complementary contact surfaces 37, 45. It has been discovered that the use of three ribs 36, 44 may be advantageous to assure that the output member 20 properly centers itself on the input member 40 during initial rotation. With three contact surfaces 37, 45, it is guaranteed that each contact surface 37, 45 will make contact. While it is advantageous that each contact surface 37, 45 make contact so the transmitted torque is evenly divided among each of the contact surfaces 37, 45, it is not required.

The members 20, 40 may be equipped with two or more ribs 36, 44. In one embodiment, the output member 20 and the input member 40 may each be equipped with three ribs 36, 44 as previously described. Preferably, the ribs 36, 44 are equiangular (i.e. evenly spaced). The output member 20 and the input member 40 may also have an unequal number of ribs 36, 44. By way of example, output member 20 has two ribs 36 and the input member 40 having three ribs 44. Further, the contact surfaces 37, 45 of the ribs 36, 44 may have different non-complementary shapes.

The present invention has been further described with the shaft 22 disposed on the output member 20 and the cavity 42 disposed on the input member 40. In another embodiment, the disposition of the shaft 22 and cavity 42 may be reversed. Further, the input member 40 may be biased outward to engage the output member 20.

The distal end 26 of the shaft 22 may have a variety of orientations including an edge 29 and a tapered surface 28 as illustrated in FIG. 4. In another embodiment, the distal end 26 may include a number of extensions that extend outward from surface 28 and contact the surface 52 of the input member 40. The extensions extend outward an equal amount forming a planar surface that contacts the surface 52.

It should be noted that the embodiment illustrated in FIG. 1 lacks material between the ribs 36, 44. This embodiment is to be contrasted with the embodiment illustrated in FIG. 2 that includes material between the ribs 36, 44. While both embodiments are otherwise equal, the embodiment illustrated in FIG. 2 is likely easier to manufacture, stronger, and assists with initial mating of the members 20, 40.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A transmission system for driving a removable unit in an image forming device comprising:

a first member aligned along a first axis and having a plurality of first ribs each with a generally arcuate contact surface extending along the first axis; and a second member aligned along a second axis and having a plurality of second ribs each with a generally linear contact surface extending along the second axis;

the first ribs and the second ribs being engagable with the first and second axis being substantially aligned, the first and second ribs being incompletely connectable to engage each other with limited contact between the generally arcuate and linear contact surfaces.

2. The system of claim 1, wherein the first ribs are disposed on a shaft.

3. The system of claim 2, wherein the second ribs are disposed in a cavity.

4. The system of claim 1, wherein each of the first and second members has a total of three ribs.

5. A system for driving a removable unit in an image forming device, comprising:

a first member rotatably coupled to the image forming device, the first member having a plurality of ribs each having longitudinal sides extending along a length of the first member with a generally arcuate contact surface;

a second member rotatably coupled to the first member, the second member having a plurality of ribs each having longitudinal sides extending along a length of the second member with a generally linear contact surface; and contact surfaces on each of the plurality of ribs that contact during engagement between the first and second members, the rotational force of the image forming device being transferred from the first member to the second member along the contact surfaces.

6. The system of claim 5, further comprising a biasing member acting on the first member to force the first member into engagement with the second member.

7. The system of claim 5, wherein each of the plurality of ribs of the second member and the first member make contact within a common plane.

8. The system of claim 5, wherein the second member ribs are helically disposed in the cavity.

9. A coupling system to transfer a rotation force within an image forming device comprising:

a first input rib and a second input rib each extending along a length of an input member, each of the input ribs having a first configuration;

a first output rib and a second output rib each extending along a length of an output member, each of the output ribs having a second configuration different than the first configuration;

the input member and the output member being coupled together during rotation of the output member with at least one of the first and second input ribs making limited contact with at least one of the first and second output ribs due to the first and second configurations being different.

10. The system of claim 9, wherein one of the first and second input ribs contacts one of the first and second output ribs.

11. The system of claim 9, wherein the first input rib contacts the first output rib and the second input rib contacts the second output rib, the contacts lying within a common plane.

12. The system of claim 9, wherein the first input rib contacts the first output rib at a first axial location along the output member and the second input rib contacts the second output rib at a second axial location along the output member.

13. The system of claim 9, wherein a distal end of the input member contacts a planar face of the output member to control an extent of engagement.

14. The system of claim 9, wherein one of the first and second configurations is an arcuate contact surface and the other of the first and second configurations is a substantially linear contact surface.

15. A method for driving a removable unit in an image forming device, comprising the steps of:

contacting a first rib having a generally arcuate contact surface against a second rib having a generally linear contact surface;

engaging the arcuate contact surface to the generally linear contact surface at a line contact; and translating the rotational force of a drive motor from the first rib through the second rib to the removable unit through the line contact between the first and second contact surfaces.

16. The method of claim 15, further comprising the step of pulling the first rib into engagement with the second rib.

17. The method of claim 15, further comprising the step of stabilizing the first rib relative to the second rib to prevent irregular translation of rotational force.

18. The method of claim 15, further comprising inserting an output member into an input member and engaging the arcuate contact surface to the generally linear contact surface at the line contact.

19. The method of claim 15, further comprising contacting third and fourth ribs against fifth and sixth ribs.

20. The method of claim 15, further comprising preventing the first and second ribs from disengaging.

* * * * *